US006439199B2

(12) United States Patent
Ramseyer et al.

(10) Patent No.: US 6,439,199 B2
(45) Date of Patent: Aug. 27, 2002

(54) PILOT OPERATED THROTTLING VALVE FOR CONSTANT FLOW PUMP

(75) Inventors: Eric D. Ramseyer, Dalton; Ulf Dreier, Wooster, both of OH (US)

(73) Assignee: Bosch Rexroth Corporation, Wooster, OH (US)

( * ) Notice: Subject to any disclaimer, the term of this patent is extended or adjusted under 35 U.S.C. 154(b) by 0 days.

(21) Appl. No.: 09/849,636

(22) Filed: May 4, 2001

Related U.S. Application Data

(63) Continuation-in-part of application No. 09/553,285, filed on Apr. 20, 2000, now Pat. No. 6,227,167.

(51) Int. Cl.[7] ..... F02M 37/04
(52) U.S. Cl. ..... 123/446; 123/467
(58) Field of Search ..... 123/446, 447, 123/506, 467

(56) References Cited

U.S. PATENT DOCUMENTS

| | | | | | |
|---|---|---|---|---|---|
| 4,719,889 | A | * | 1/1988 | Amann et al. | 123/447 |
| 4,884,545 | A | * | 12/1989 | Mathis | 123/447 |
| 5,191,867 | A | | 3/1993 | Glassey | |
| 5,458,103 | A | * | 10/1995 | Lauvin | 123/456 |
| 5,515,829 | A | | 5/1996 | Wear et al. | |
| 5,788,469 | A | | 8/1998 | Novacek et al. | |
| 5,809,863 | A | | 9/1998 | Tominaga et al. | |
| 5,884,606 | A | * | 3/1999 | Kellner et al. | 123/446 |
| 5,927,322 | A | * | 7/1999 | Rosenau | 123/447 |
| 5,957,111 | A | | 9/1999 | Rodier | |
| 5,971,718 | A | * | 10/1999 | Krueger | 417/289 |
| 6,035,828 | A | | 3/2000 | Anderson et al. | |
| 6,036,448 | A | | 3/2000 | Fiddes | |
| 6,058,912 | A | * | 5/2000 | Rembold | 123/516 |
| 6,074,175 | A | | 6/2000 | Hoshi et al. | |
| 6,142,120 | A | * | 11/2000 | Biester et al. | 123/456 |
| 6,217,289 | B1 | | 4/2001 | Smith | |
| 6,223,725 | B1 | * | 5/2001 | Onishi et al. | 123/447 |
| 6,234,148 | B1 | * | 5/2001 | Hartke et al. | 123/447 |
| 6,253,734 | B1 | * | 7/2001 | Rembold et al. | 123/446 |
| 6,345,608 | B1 | * | 2/2002 | Rembold | 123/506 |

OTHER PUBLICATIONS

SAE Technical Paper 2000–01–0687, entitled "Development of a Variable–Displacement, Rail–Pressure Supply Pump for a Dimethyl Ether" by James C. McCandless, Ho Teng and Jeffrey B. Schneyer presented Mar. 6–9, 2000.

* cited by examiner

*Primary Examiner*—Thomas N. Moulis
(74) *Attorney, Agent, or Firm*—Frank J. Nawalanic; Victor A. Henzi

(57) ABSTRACT

A pilot operate, throttling valve is provided for a pump that has inlet valving sufficient to permit the pump to operate with charged fluid at a varying inlet pressure. The throttling valve includes a flow control slave valve operated by a pressure unbalanced mechanical actuator. The pressure differential in the actuator controlling the flow in the slave valve results from a constant pressure produced by a conventional pressure regulating valve generating an actuator force which is reduced by a controlled pressure generated from a solenoid actuated control valve. Because pressure, not flow, controls the pilot, the throttling valve is particularly suited for HEUI applications where the ECM must quickly and accurately control the pump irrespective of viscosity and flow considerations of the pumped oil.

29 Claims, 6 Drawing Sheets

PILOT OPERATED THROTTLING VALVE FOR CONSTANT FLOW PUMP

This invention is a continuation-in-part of Ser. No. 09/553,285, filed Apr. 20, 2000, entitled "Suction Controlled Pump for HEUI Systems" and now allowed as to be granted U.S. Pat. No. 6,227,167 to be issued on or about May 8, 2001 (the parent patent).

This invention relates generally to a control system for a fixed displacement, constant flow pump and more particularly to a hydraulicly actuated electronically controlled unit injector (HEUI) fuel control system using the fixed displacement constant flow pump.

This invention is particularly applicable to and will be described with specific reference to a throttling valve controlling metering of low pressure fluid into a high pressure pump used in a HEUI flow control system. However, the invention has broader application and may be applied to other systems using a constant flow, fixed displacement pump requiring fast response over a wide range of operating conditions such as that which is required in vehicular steering systems.

BACKGROUND a) Conventional Systems

As is well known, a hydraulically-actuated electronically-controlled unit injector fuel system has a plurality of injectors, each of which, when actuated, meters a quantity of fuel into a combustion chamber in the cylinder head of the engine. Actuation of each injector is accomplished through valving of high pressure hydraulic fluid within the injector under the control of the vehicle's microprocessor based electronic control module (ECM).

Generally, sensors on the vehicle impart engine information to the ECM which develops actuator signals controlling a solenoid on the injector and the flow of hydraulic fluid to the injector. The solenoid actuates pressure balanced poppet valves such as shown in U.S. Pat. Nos. 5,191,867 and 5,515,829 (incorporated by reference herein). The poppet valves in the injector port high pressure fluid to an intensifier piston which causes injection of the fuel at very high pressures. The pressure at which the injector injects the fuel is a function of the hydraulic fluid flow supplied the injector by a high pressure pump while the timing of the injector is controlled by the solenoid. Both functions are controlled by the ECM to cause precise pulse metering of the fuel at desired air/fuel ratios to meet emission standards and achieve desired engine performance. Tightening emission standards and a demand for better engine performance have resulted in continued refinement of the control techniques for the injector. Generally the pump flow output has to be variable throughout the operating range of the engine. For example, one manufacturer may desire a constant pump flow throughout an operating engine speed range except at the higher operating engine speeds whereat the injectors are valving so quickly reduced pump flow may be desired even though more fuel is being injected by the injectors to the combustion chambers. Other manufacturers may desire to rapidly change pump flow at any given instant for emission control purposes. For example, the ECM may sense a step load change on the engine and impose a change in the fuel/air ratio to overcome the effects of a transient emission. Still further, the operating vehicular environment severely impacts oil viscosity affecting pump flow and injector performance. Viscosity of the hydraulic fluid is affected by several variables besides heat and is difficult to program into the ECM to fully account for its affect on system performance.

In a HEUI system, high pressure hydraulic actuating fluid is supplied to each injector by a high pressure pump in fluid communication with each injector through a manifold/rail fluid passage arrangement. The high pressure pump is charged by a low pressure pump. As noted in the '867 patent, the high pressure pump is either a fixed displacement, axial piston pump or alternatively a variable displacement, axial piston pump. If a fixed displacement pump is used, a rail pressure control valve is required to variably control the pressure in the manifold rail by bleeding a portion of the flow from the high pressure pump to a return line connected to the engine's sump. For example, the '867 patent mentions varying the output of the high pressure pump by the rail pressure control valve to pressures between 300 to 3,000 psi. A variable displacement pump can eliminate the rail control valve if the flow output of the variable pump can timely meet the response demands imposed by the HEUI system. The pumps under discussion are axial piston pumps in which the pump stroke (displacement) is determined by the angle of the swash plate. Variable displacement, axial piston pumps use various arrangements to change the swash plate angle and thus the piston stroke. Generally speaking, variable output, axial piston pumps do not have the reliability of a fixed displacement, axial piston pump and are more expensive. More significantly, the response time demands for pump output flow in a HEUI system is becoming increasingly quicker and a variable pump may be unable to change output flow within the time constraints of a HEUI system unless a rail pressure control valve is used.

A fixed displacement, high pressure pump is typically used in HEUI systems because of cost considerations. The pump is sized to match the system it is applied to. It is well known that the flow of a fixed displacement pump increases, generally linearly, with speed. Accordingly, the fixed displacement pump is sized to meet HEUI system demands at a minimal engine speed which is less than the normal operating speed ranges of the engine. Higher engine speeds produce excess pump flow which is dumped by the rail pressure control valve to return. The excess flow represents an unnecessary power or parasitic drain on the engine which the engine manufacturers have continuously tried to reduce.

For example, U.S. Pat. No. 5,957,111 shows a control scheme in which excess pump flow is passed to an idle injector but at a rate insufficient to actuate the injector. The system is stated to allow elimination of the rail pressure control valve and permit a more accurate sizing of the fixed displacement pump. However, the system does not avoid unnecessary parasitic engine power drains imposed by the pump. The pump must still be sized to produce a set flow sufficient to actuate the injectors at a low speed and that flow increases with pump speed.

b) The Parent Patent

The parent patent (incorporated herein by reference in its entirety herein) discloses a fixed displacement, axial pump which in contrast to conventional axial piston pumps, eliminates the kidney shaped ports, rotates the cylinder, fixes the swash plate against rotation and establishes an orificed, suction slot inlet for each piston. The suction slot draws a constant volume of fluid into each pump cylinder once pump operating speed is reached to produce a constant flow output from the pump. The pump can therefore be designed to produce the maximum flow required by the HEUI system (i.e., at low operating speeds) which maximum does not increase when pump speed increases as in fixed displacement, axial piston pumps. The power otherwise expended to drive conventional fixed displacement pumps beyond their designed "maximum" is not required.

Improved vehicle performance, better fuel consumption and decreased emissions results because the parasitic power drain is removed.

Additionally, and as noted above, there are times during the vehicle's operation where less flow from the required "maximum" is sufficient to operate the injectors and desired for better injector performance, enhanced fuel consumption, etc. In the parent application, it was demonstrated that controlling the flow of fluid to the constant volume high pressure pump by a throttling valve could produce a constant pump output flow at any desired level. The results and benefits achieved by the constant flow pump as discussed above relative to the maximum output sizing consideration, can therefore be achieved throughout the operating range of the pump by a throttling valve at the pump inlet. Parasitic power drains on the system are thus alleviated over the entire operating range of the engine.

The throttling valve generally disclosed in the parent application was simply a solenoid operated valve under the control of the ECM and similar to the high pressure, axial pressure control valve (RPCV) currently used in conventional systems. Because the solenoid valve is controlling the flow of a low pressure pump, its sizing is reduced decreasing its cost. While the solenoid operated valve can throttle the flow to the inlet of the constant flow pump, the viscosity changes in the hydraulic fluid such as the variations that can occur between ambient vehicular start-up temperatures and the sudden fluid flow changes occurring during normal operating conditions, such as that occurring during vehicle acceleration or deceleration, impose requirements on a conventional solenoid valve which are difficult to achieve.

SUMMARY OF THE INVENTION

Accordingly, one of the major undertakings of this invention is to provide a throttling valve for the constant flow pump inlet which is responsive to the various demands imposed on the pump by the system, particularly a HEUI system.

This feature along with other advantages of the invention is achieved in an internal combustion engine having a hydraulically-actuated electronically-controlled fuel injection system of the type including a fuel injector valving high pressure fluid in response to commands from an electronic command module (ECM) to timely inject a metered quantity of fuel into the engine's combustion chamber. The injector is in fluid communication with the outlet of a high pressure pump in turn having an inlet in fluid communication with a low pressure pump. This system includes, in the preferred embodiment, an axial piston, fixed displacement high pressure pump producing a generally constant flow of fluid throughout the operating range of the high pressure pump, but in a broader sense, covers any pump which can be throttled controlled at the pump inlet. Coupled to such high pressure pump is a throttling valve having an inlet in fluid communication with the low pressure pump and an outlet in fluid communication with the high pressure pump. The throttling valve has a flow control slave valve providing a variably set flow from the throttling valve inlet to the throttling valve outlet and a pilot operated spool valve controlling the variably set flow of the slave valve whereby the flow rate of the pump may be variably set to a desired flow within a large operating condition range.

In accordance with another aspect of the invention, the spool valve includes a regulating valve for exerting a generally constant pressure on the spool valve tending to further increase the set flow of the slave valve and a solenoid actuated pressure control flow exerting a pressure on the spool valve acting opposite to the constant pressure whereby the spool valve functions as a hydraulically unbalanced, mechanical actuator controlling the slave valve to achieve a throttling valve more responsive to command positions than that which can be achieved by a direct actuated valve such as a solenoid actuated poppet valve. More particularly, the solenoid valve is somewhat isolated from viscosity variations in the pump oil because its function is to simply create a pressure for the actuator. It is not exposed to oil flow forces through the valve which vary with viscosity changes.

In accordance with another feature of the invention, the slave valve includes a slave valve housing containing a flow valve passage therein and a longitudinally extending, cylindrical sleeve within the flow valve passage having an inlet opening in fluid communication with the inlet and an outlet opening in fluid communication with the outlet. A cylindrical hollow piston having a closed end is positioned within the sleeve. The sleeve or the piston has a plurality of longitudinally spaced orifice openings of set variable size extending therethrough for providing fluid communication from the throttling valve inlet to the throttling valve outlet through select orifice openings in registry with either the inlet or outlet openings as a result of piston position. A spring biases the piston to a stop position acting against the bias of the unbalanced mechanical actuator. By sizing select orifice openings (dimensional size and longitudinal distance), the area of the slave valve can remain in a full open position for a set travel of the piston to compensate for viscosity variations in the pump oil during engine warm-up.

It is thus one object of the invention to provide a pilot operated throttling valve for an inlet of any constant flow axial piston pump used in any system which is capable of controlling flow to the pump over a wide range of flow rates and fluid viscosities.

Another feature of the invention is to provide a throttling valve of the type generally described in a HEUI system which uses a solenoid valve controlled by the ECM that can be sized smaller and consequently be less expensive than that required of a solenoid valve functioning as a direct throttling valve.

Still another important object of the invention is to provide an improved HEUI system that uses a constant flow, axial piston pump with a pilot operated throttling inlet valve that accomplishes one or more or any combination of the following:

a) elimination or reduction of parasitic power drains on the engine thereby producing improved power or performance, better fuel economy, less emissions, etc.;

b) generally full flow at start-up and during warm-up independent of viscosity and flow rate variation;

c) minimal flow, or optionally, full flow upon electrical system failure;

d) minimize adverse effects on destroking the pump; and, e) generally excellent response to ECM commands permitting stable and controllable HEUI operation and/or future developments or enhancements of HEUI systems.

These and other objects, features and advantages of the invention will become apparent to those skilled in the art upon reading and understanding the Detailed Description of the Invention set forth below.

BRIEF DESCRIPTION OF THE DRAWINGS

The invention may take form in certain parts and arrangement of parts, a preferred embodiment of which will be described in detail and illustrated in the accompanying drawings which form a part hereof and wherein.

DETAILED DESCRIPTION OF THE INVENTION

A) The HEUI System

Figure 1:
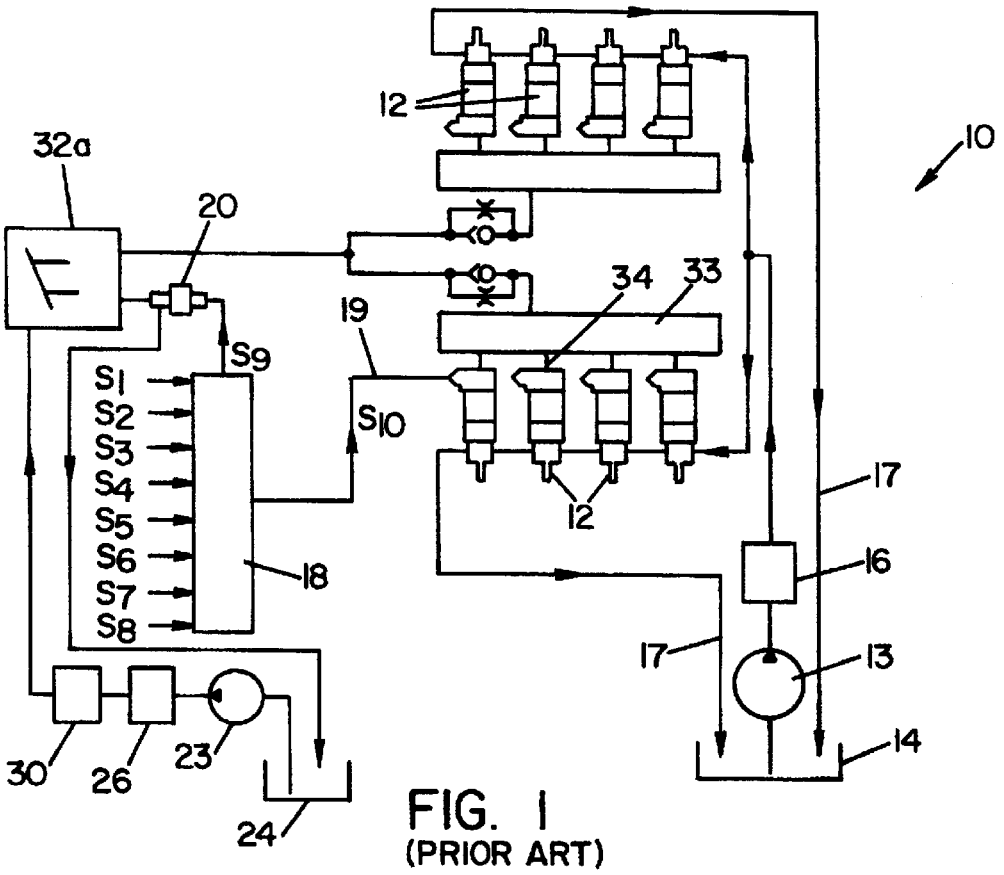
FIG. 1 (PRIOR ART)
FIG. 1 is a prior art schematic illustration of a HEUI fuel injection system.
Figure 2:
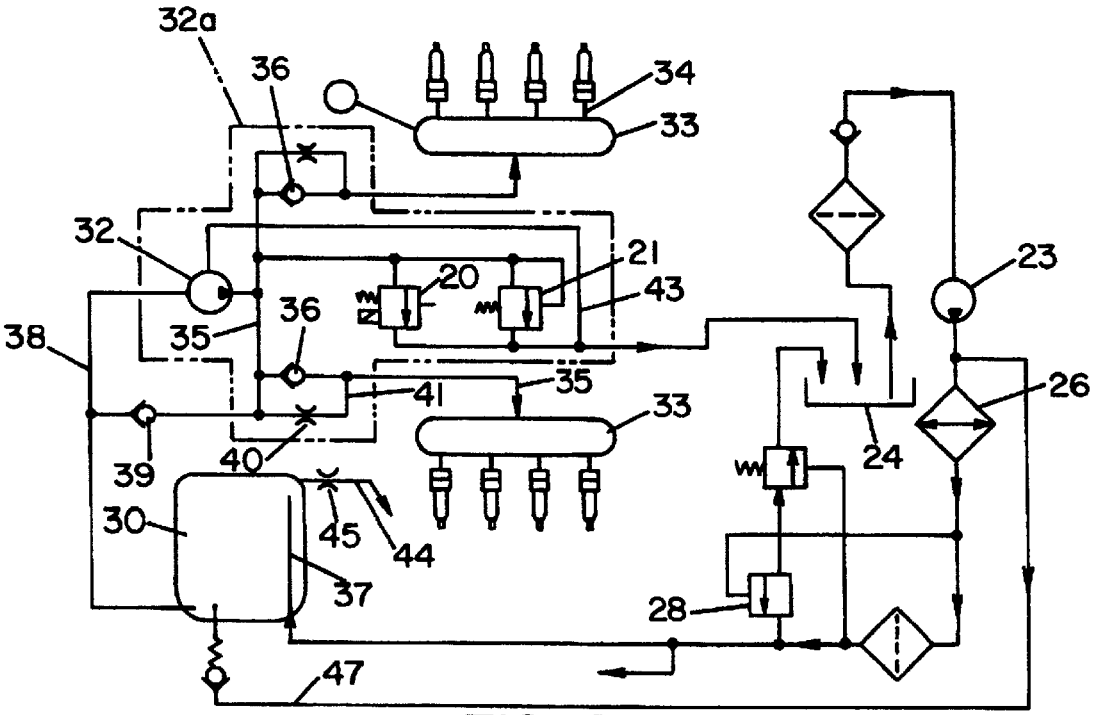
FIG. 2 (PRIOR ART)
FIG. 2 is a prior art schematic hydraulic actuating fluid circuit diagram for the injection system shown generally in FIG. 1.

Referring now to the drawings wherein the showings are for the purpose of illustrating a preferred embodiment of the invention only and not for the purpose of limiting the same, reference is first had to a description of a prior art HEUI system as shown in FIGS. 1 and 2 since the present invention may be perhaps best explained by reference to an existing arrangement.

The system shown in FIGS. 1 and 2 will only be described in general terms and reference should be had to the patents discussed in the Background for a more detailed explanation of the system including the operation of the fuel injector, per se, which is not shown in detail herein.

Referring first to prior art FIG. 1, there is diagrammatically shown an HEUI fuel injection system 10 which includes a plurality of unit fuel injectors 12. A fuel pump 13 draws fuel from the vehicle's fuel tank 14 and conditions the fuel at a conditioning station 16 before pumping the fuel to individual injectors 12 as shown. One or more fuel return lines 17 is provided. The fuel supply system as shown is separate and apart from the hydraulic system which actuates fuel injectors 12. It is understood that the engine fueled by injectors 12 is typically a diesel engine and that diesel fuel (fuel oil) can be optionally used as the fluid to power injectors 12. In the preferred embodiment, engine oil is used to actuate injectors 12. Those skilled in the art will recognize that the present invention is functional in those systems which use diesel fuel pumped under high pressure to actuate injectors 12.

Fuel injectors 12 are actuated by hydraulic pressure which, in turn, is regulated by signals generated by an electronic control module, ECM 18. ECM 18, in response to a number of sensed variables, generates electrical control signals which are inputted at 19 to a solenoid valve in each fuel injector 12 and to a rail pressure control valve 20 which determines the pressure of engine oil pumped to fuel injectors 12 by a high pressure pump 32.

More particularly, ECM 18 receives a number of input signals from sensors designated as S1 through S8. The sensor signals represent any number of variables needed by ECM 18 to determine fueling of the engine. For example, input signals can include accelerator demand or position, manifold air flow, certain emissions sensed in the exhaust, i.e., HC, CO, NOx, temperature, engine load, engine speed, etc. In response to the input signals, ECM accesses maps stored in look-up tables and performs algorithms, also stored in memory, to generate a fueling signal on S9 which is inputted as an electrical signal to rail pressure control valve 20 and a signal on S10 which takes the form of an electrical signal actuating a solenoid in injector 12. Injector 12 is entirely conventional and can take any one of a number of known forms. For purposes of this invention, it is believed sufficient to state that high pressure fluid from a high pressure pump is supplied to the injectors. The pump fluid, which is supplied injectors 12 is, in the preferred embodiment, engine oil and drains from the injectors back to the engine sump (oil pan) through the engine's case (valve housing). Generally, pressure balanced poppet valves actuated by the solenoid, direct high pressure pump fluid against a pressure intensifier within injector 12. The pressure intensifier pressurizes diesel fuel to very high pressures (as high as 20,000 psi while high pressure pump pressure is not higher than about 4,000 psi) and ejects a pulse of fuel at this high pressure into the engine's combustion chamber. Poppet valve design, the staging or sequencing of the poppet valves, the degree of solenoid actuation, etc. will vary from one engine manufacturer to the next to generate a particular fuel pulse matched to the ignition/combustion characteristics of the combustion chamber formed by the geometry of the engine's piston/cylinder head. Various pulses such as square, sine, skewed, etc. can be developed by the injector 12 in response to solenoid signals from ECM 18.

As noted in the Background, the HEUI system has enjoyed its widespread acceptance because its operation is not affected by the speed or load placed on the engine. However, the HEUI system requires high pressure actuating fluid to operate and the flow rate of the fluid has to be variable on demand to produce the desired feed pulse from the injector. Again, how the pulse is developed is beyond the scope of this invention. It is sufficient for an understanding of the present invention to recognize that the pump supplying actuating fluid to the injectors must achieve a minimum flow rate which allows the injector to achieve maximum fuel pressure. Once the high pressure pump achieves this output, the HEUI system, through rail pressure control valve (RPCV) 20 may reduce the pump flow on demand for any number of reasons to produce a desired fuel pulse. For example, one engine manufacturer may desire a constant pump flow through the operating range except that at high operating engine speeds, the poppet valves within injectors 12 may cycle so quickly that it is desirable for pump flow to be reduced. That is the pressure of the fluid can be transferred instantaneously before the hydraulic fluid drain through the injector "catches up". Another manufacturer may sense load changes imposed on the engine and throttle the high pressure pump flow, at any engine operating speed, for emission purposes. In conventional systems, high pressure pump 32 supplies excess flow to injectors 12 which excess flow is returned to drain through RPCV 20 and the excess flow continues to increase as the pump speed increases. While rail pressure control valve 20 has been refined to timely respond to ECM demands, it should be clear that if the pump's excess flow can be reduced to more closely model system flow demands, the size (and expense) of rail pressure control valve 20 can be reduced.

As shown in prior art FIGS. 1 and 2, oil from the vehicle's conventional oil pump or low pressure pump 23 is cooled by a conventional radiator core 26. A low pressure oil stream produced by a pressure valve 28 fills a priming reservoir 30 which is in fluid communication with the inlet end of a high pressure pump 32. High pressure pump 32 includes the components shown in FIG. 2 within dot-dash line indicative of pump housing 32*a*. High pressure pump 32 pressurizes the engine oil at the high pressure pump's outlet (now termed actuating oil) which is in fluid communication with common rail passage 33 in the manifold which, in turn, is in fluid communication with rail branch passages 34 leading to actuating ports within individual fuel injectors 12. In the prior art arrangement shown in FIGS. 1 and 2, a vee-type engine is used so there are two manifolds and two sets of rails. Also, for convenience in notation, reference to "rail" means the common rail passage 33 and rail branch passages 34 and can optionally include the actuating oil supply line 35 leading from the outlet of high pressure pump 32 to the manifold. When high pressure pump 32 is operating, pressure of the actuating oil in manifold/rail passages 33, 34 as noted above is determined by the actuation of rail pressure control valve 20 which is backed up with a safety relief valve 21.

Referring now to prior art FIG. 2, priming reservoir 30, in addition to functioning as an oil reservoir supplying oil to the inlet of high pressure pump 32, functions also as a reservoir to maintain oil in the high pressure pump inlet supply line 38 and oil in high pressure pump 32 as well as oil in the manifold/rail passages 33, 34 when high pressure pump 32 doesn't operate. This is achieved by physically positioning priming reservoir 30 at an elevation above the inlet port of high pressure pump 32 and above manifold/rail passages 33, 34 and specifically, the use of a stand pipe 37 at that elevation to establish a gravity flow from priming reservoir 30. Make-up oil flows past a one way check valve 39 (oil ferry) through an optional flow restriction orifice 40 in a bypass line 41 which communicates with actuating supply line 35. Orifice 40 in combination with check valves 36 also functions to control Helmholtz resonance for balancing pressure surges or waves between the two manifolds for the vee-type engine illustrated. The make-up oil from priming reservoir 30 thus flows to the actuating supply line 35 and then to manifold/rail passages 33, 34. Make-up oil also flows through actuating supply line 35 to the outlet of high pressure pump 32. Leakage within high pressure pump 32 returns to crank case sump 24 through a fluid leakage supply line 43. When priming reservoir 30 is filled by low pressure pump 23 excess oil and air is vented for return to crank case sump 24. In the prior art FIG. 2 this occurs through an overflow return line 44 which includes an orifice 45 to maintain a slight pressure in priming reservoir 30. It is or should be clear that in the HEUI system embodiment shown in FIGS. 1 and 2, the inlet of high pressure pump 32 during engine operation is charged through reservoir 30 at the pressure of low pressure pump 23.

This invention, in its broad sense, is not limited to a HEUI system. However, like the HEUI system disclosed in FIGS. 1 and 2, a source of fluid, at some low pressure, must be available to charge the inlet of the high pressure pump.

B) The High Pressure Pump

This invention is limited to a pump that can be throttled at its inlet. That is, the rate of flow of the hydraulic fluid at the inlet of the high pressure pump can be varied. The change in inlet flow has to be accomplished without cavitation. In a HEUI system, it is conventional to use as the high pressure pump, an axial piston, fixed displacement pump for reasons discussed in the Background above. Accordingly, because the preferred embodiment of the invention is its utilization in a HEUI system, the preferred embodiment of this invention prefers that a fixed displacement axial piston pump that can be throttled at its inlet without cavitation be utilized. The parent patent disclosed such a pump and a section through the pump of the parent patent is duplicated in FIG. 3 to show an example of a fixed displacement, axial piston pump that can be throttled at its inlet. The pump in FIG. 3 uses an orifice inlet or suction intake that produces, for inlet fluid at a constant pressure, a constant flow once the operating speed of the pump is reached. More particularly, once the critical (operating) speed of the pump is reached, maximum flow is realized and further speed increases do not produce increase in flow through the orifice. Other orifice inlet solutions are suggested for the pump and reference should be had to the parent patent for a more detailed explanation than that described herein.

Figure 3:
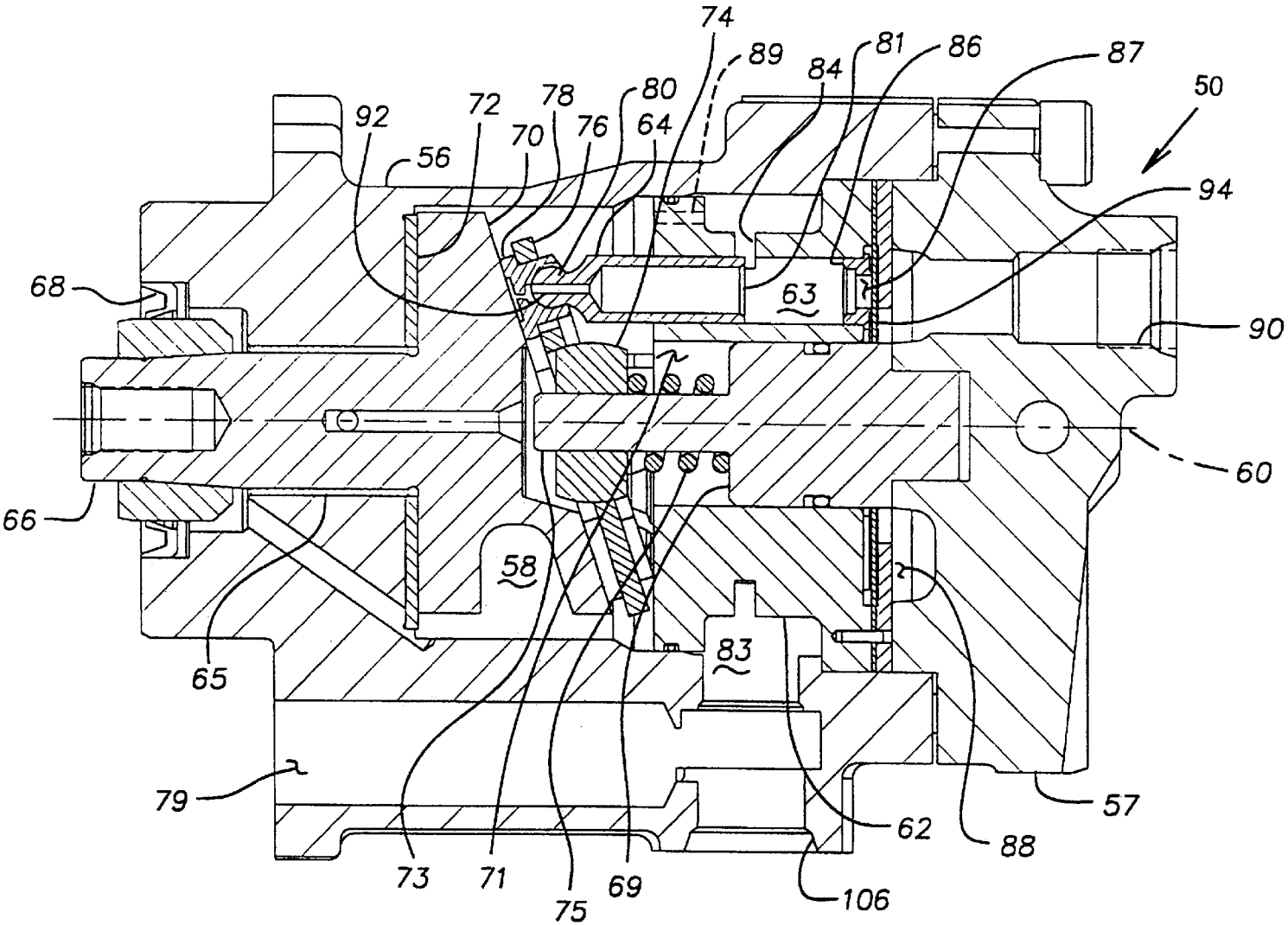
FIG. 3 is a sectioned side elevation view of a fixed displacement, constant flow pump suitable for use in the present invention and shown in the parent patent application.

Axial piston pump 50, shown in FIG. 3, includes an open ended pump housing 56. Pump housing 56 has at one axial end an inlet shaft passage 65, at its opposite axial end a cylinder chamber 71 and interconnecting inlet shaft passage 58 with cylinder chamber 71 is an intermediate or swash plate chamber 58. Inlet shaft passage 65, cylinder chamber 71 and swash plate chamber 58 extend along and are generally concentric about longitudinal centerline 60. Closing cylinder chamber 71 is an end plate 57 which has formed therein a pump outlet 90 which is in fluid communication with an annular pump discharge chamber 88.

Disposed within cylinder chamber 71 is an annular cylinder 62 which is made non-rotatable by the clamping force between end plate 57 and pump housing 56 exerted by cap screws when the pump is assembled. Extending through the ring body of cylinder 62 is a plurality of circumferentially spaced piston bores 63 each of which contains a piston 81 axially movable therein. One end of each piston 81 extends through each piston bore 63 and is formed in the shape of a ball 80 Each ball 80 is received within a socket formed in a slipper 78 so that the ball socket joint allows each slipper 78 to pivot omni-directionally.

Inserted within the central opening of cylinder 62 is a cylindrical tail shaft 69 which has a cylindrical stem portion 71. Stem portion 71 receives an annular spherical bearing 74 which has its outside diametrical surface formed as a sphere. A compression spring 73 fits over stem portion 71 and seats on tail shaft 69 as shown so that its biasing force tends to push spherical bearing 74 off tail shaft 71. Spherical bearing 74 is maintained in its position by an annular retainer plate 76 having a plurality of circumferentially spaced slipper openings which engage or fit within a stepped flange formed in slippers 78. The central opening of retainer plate 76 has a through diameter slightly less than the spherical diameter of spherical bearing 74 so that retainer plate 76 holds spherical bearing 74 at its axial position on stem portion 71 with the axial force of spring 75 transmitted to slippers 78. The surface of the central opening is dished or curved at a spherical diameter equal to or greater than the spherical diameter of spherical bearing 74 so that retainer plate 76 can wobble or pivot about the outside spherical surface of spherical bearing 74 as pistons 81 axially move within piston bores 63. An inlet shaft 66 has an inlet shaft portion within inlet shaft passage 65 and a swash plate portion 70 within swash plate chamber 54.

Figure 4:
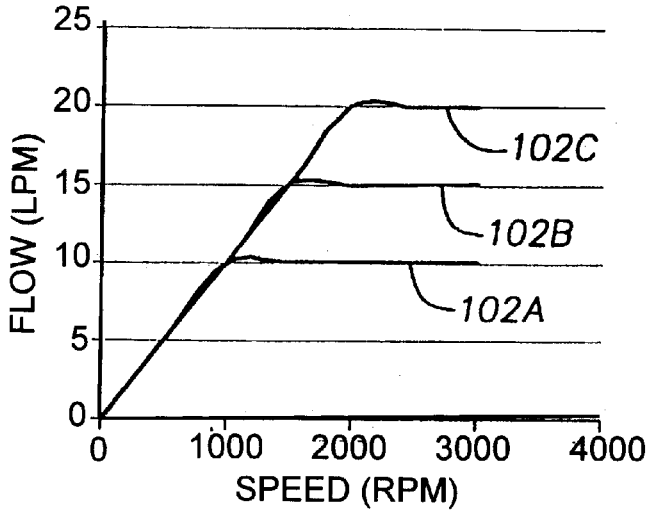
FIG. 4 is a constructed graph showing various flow rates achieved by a fixed displacement, constant flow pump with inlet pump flow throttled and is duplicated from the parent patent.

The operation of pump 50 is opposite to that of a conventional Thoma pump. Rotation of inlet shaft 66 causes swash plate portion 70 to rotate and axially move the swash plate surface relative to piston bores 63 which are stationary. Slippers 78 cause pistons 81 to axially move within piston bore 63. Fluid from an inlet port 79 is drawn into piston bore 63 through a suction slot 84 during the suction stroke of piston 81. When piston 81 axially travels forward in piston bore 63, communication of suction slot 84 is cut off and compressed fluid exits piston bore 63 through a valved outlet shown as a read-valve 94 into discharge chamber 88 and out through pump outlet 90. The flow from pump 50 is constant, after the operating speed of the pump is reached, provided the pressure at the pump inlet remains generally constant. As explained in the parent patent, suction slot 84 behaves as an orifice which, for a given pressure at the inlet, supplies a constant flow of fluid through the slot. Once the critical or operating speed of pump 50 is reached, further pump speed increases do not result in an increase of flow through the suction slot and the pump flow output is substantially constant. More particularly, if the inlet pressure of the charge inlet of the pump is reduced from a set value, the constant flow will be reduced and reduced at some set relationship. This was demonstrated in the parent patent by the graph shown in FIG. 4. FIG. 4 shows operating speed flow curves 102A, 102B and 102C. Inlet pressure is constant for each curve but the inlet pressure for curve 102A is less than that for inlet curve 102B which is less than that for inlet curve 102C. In each case, an operating speed is reached whereat constant pump flow occurs but knee 101 at which the pump transitions to its operating (or critical) speed shifts with increasing inlet pressure. FIG. 4 shows that it is possible by throttling the inlet flow, to variably control the pump's output flow when the pump is within its operating speed range. That is, the output flow of pump 55 at any speed within the pump's operating speed can be controlled by throttling the inlet flow.

The parent patent disclosed other arrangements besides suction slot 84 which can be utilized in an axial piston pump to function as an orifice or for each piston bore 63 which is fixed so that fluid at a set pressure at the inlet (or the orifice entrance) to each piston bore can only flow through the inlet (orifice) at a maximum flow rate which is reached at the critical speed of the pump. Other arrangements may be utilized. The orifice or inlet may be at the base of the slipper or passages can be formed in the swash plate 70 and communicate as a function of time with each piston bore by rotation of the swash plate. The variations of the suction slot pump shown in FIG. 3 as discussed may not produce a truly constant flow of the pump after the critical speed is reached because of the design by which the metering of fluid to the piston bore is achieved. It may be possible to produce some increase in flow after critical speed is reached. However, all the variations discussed will produce a decrease in flow output if the flow of fluid to the pump inlet is decreased. That is, all variations use some form of an inlet orifice to the piston chamber through which flow of fluid is limited at some maximum rate. That maximum rate is affected by the pressure and flow of the fluid supplied to the orifice. It may also be affected, depending on the design, by the conditions on the opposite side of the orifice (i.e., the piston bore) and in that instance some variation in flow may occur as pump speed increases beyond the critical speed. Therefore as a matter of definition, and as used in this patent, a "throttled inlet pump" means a pump whose flow output can be controlled by controlling the flow of fluid to the inlet of the pump because the flow of fluid into the piston chamber is basically through an orifice opening. In accordance with this definition, the output flow from the pump may increase with increases in pump speed after the operating or central speed of the pump has been reached depending on the inlet valving design by which inlet fluid is transmitted to piston bore 63. When that valving is of the type as disclosed for example, in the parent patent, the pump will be referred to as a "throttled inlet pump having a generally constant output flow" which means the output flow is generally constant throughout its operating speed range. That is, pump flow output may increase with increasing pump speed, but the pump flow output does not materially or substantially increase. Finally, the discussion and examples have been limited to axial piston pumps which have particular application, as modified, to produce a constant flow output. However, similar concepts could be applied to vane pumps.

C) The Throttling Valve

Figure 5:
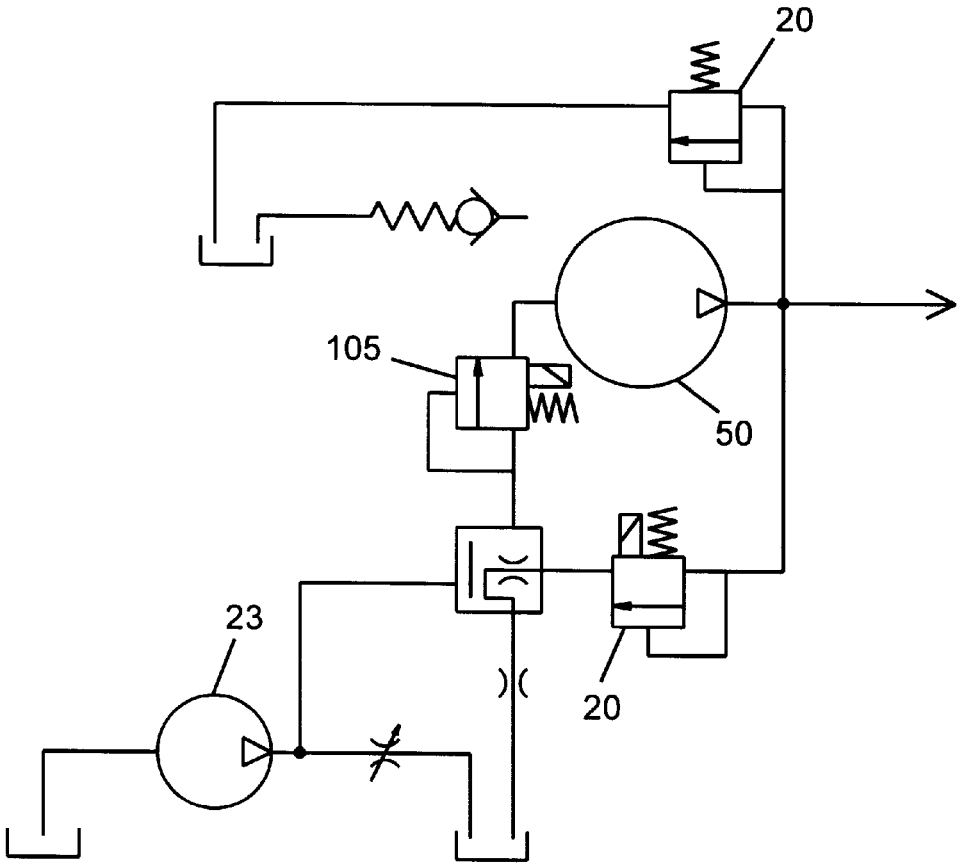
FIG. 5 is a schematic hydraulic circuit employing a solenoid controlled throttling valve similar to FIG. 2 and is duplicated from the parent patent.

The parent patent recognized that RPCV 20, which was theretofore placed downstream of high pressure pump 50, could be placed upstream of the high pressure pump and avoid the parasitic power drain of the conventional high pressure pump 32. An RPCV hydraulic circuit using a downsized solenoid operated valve, such as a solenoid throttling valve 105, was constructed and is duplicated herein as FIG. 5. Solenoid throttling valve 105 functions to control the pressure (and flow) of the low pressure pump to high pressure pump 50 in response to commands from the ECM. This system is functional. However, it has been determined that because of viscosity changes or ranges of viscosity of the hydraulic oil to which the pump is subjected and because of the different flow rates which have to be throttled, solenoid valves of considerable size (having power to infinitely change flow rates over large operating flow conditions at various viscosities) and expense was required. This is so even considering that the solenoid valve is controlling the flow of a low pressure pump and not a high pressure pump. The throttling valve of this invention allows the solenoid valve to be considerably downsized and operate within the broad operating ranges required of a HEUI system.

Figure 6:
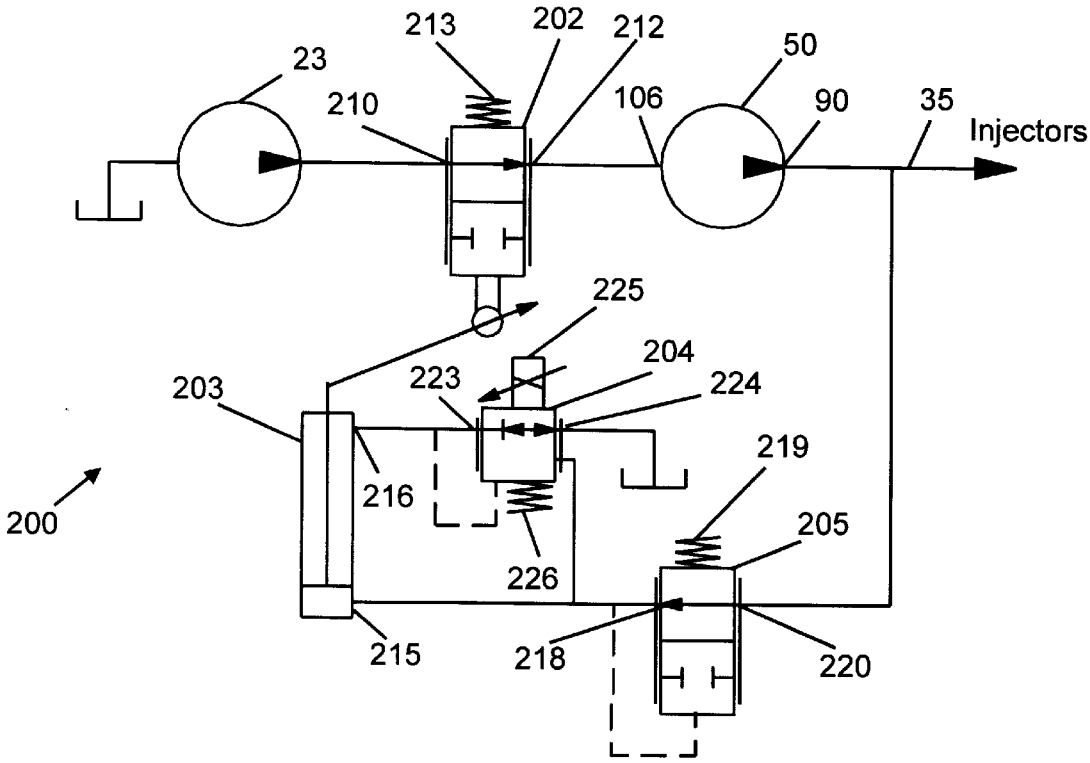
FIG. 6 is a schematic hydraulic circuit similar to FIG. 5 but schematically showing the components of the throttling valve of the present invention.

Referring now to FIG. 6, there is schematically depicted throttling valve 200 of the present invention positioned between low pressure or charge pump 23 and high pressure pump 50 for the HEUI system discussed above. Throttling valve 200 can be viewed as functionally including a flow control valve 202, a mechanical actuator 203, a solenoid operated, pressure reducing or control valve 204 and a pressure regulating valve 205.

As discussed, low pressure fluid (at 20 to 60 psi) from charge pump 23 enters inlet 210 of flow control valve 202 at an initial charge pump pressure, $P_{I2}$. Flow control valve 202 meters charge pump pressure $P_{I1}$ to a desired flow control outlet pressure which is outputted at flow control valve outlet 212 and inputted to inlet 106 of high pressure pump 50 at a desired high pressure inlet pump pressure, $P_{I2}$. High pressure pump 50 generates high pressure outlet pump pressure $P_O$ at pump outlet 90 transmitted to the injectors from rail 35. In the preferred embodiment, for a constant high pressure inlet pump pressure $P_{I2}$, high pressure pump 50 produces, at operating pump speeds, a generally constant outlet flow which is at a generally constant high pressure outlet pump pressure $P_O$.

As schematically indicated in FIG. 6, flow control valve 202 is biased by a spring 213 into, for the preferred embodiment, a full open position. Mechanical actuator 203 opposes the bias of spring 213 and if the mechanical force of mechanical actuator 203 overcomes the bias of spring 213, flow control valve 202 will be moved into a closed position whereat high pressure pump inlet pressure $P_{I2}$ will reduce to zero. The force developed by mechanical actuator 203 is a function of the differential in pressure between two fluid pressures exerted at opposite sides or spool ends of mechanical actuator 203. Fluid at a regulated pressure, $P_R$, is introduced at a closing end 215 of mechanical actuator 203 and the force developed by regulated pressure $P_R$ is counterbalanced by fluid at a control pressure, $P_C$, introduced at a counterbalancing or control end 216 of mechanical actuator 203. Mechanical actuator 203 controls flow control valve 202 which is thus a slave to the actuator.

Regulated pressure $P_R$ is produced at an outlet 218 of pressure regulating valve 205 which is a conventional regulating valve using a preset bias of a spring 219 to drop the pressure of high pressure pump output $P_O$ introduced to regulating valve inlet 220 to produce regulated pressure $P_R$. Regulating valve 205 does not meter any appreciable flow of fluid from high pressure pump output to drain (not shown in schematic of FIG. 6) and does not materially change high pressure pump output pressure $P_O$ in rail 35. If high pressure pump output $P_O$ drops to an unactuated pressure, i.e., engine shut-off condition, regulating valve spring 219 will open fluid communication between regulating valve inlet and outlet 220, 218 so that fluid remains in mechanical actuator 203 at some nominal pressure.

Fluid at control pressure $P_C$ is produced at an outlet 223 of pressure control valve 204. Fluid at regulated pressure $P_R$ from outlet 218 of regulating valve 205 is introduced at an inlet 224 of pressure control valve and metered to a set pressure by a solenoid 225 acting against the bias of a pressure control spring 226. Solenoid 225 is under control of ECM 18 and has the ability to meter flow through pressure control valve 204 from zero to regulated pressure $P_R$. In event of solenoid failure, fluid communication from regulating valve outlet 218 to control valve outlet 223 is closed thus forcefully biasing actuator 203 and consequently valve 202 to the closed position preventing the supply of oil from pump 50 to rail 35.

In the preferred embodiment and on start-up of a cold engine, high pressure pump output $P_O$ will be insignificant and fluid connections 220, 218 along with fully actuated solenoid 225 and fluid connection 218, 223 will place balancing forces on mechanical actuator 203 so that pressure in passages 215 and 216 are equal. Consequently, flow control spring 213 will bias flow control valve 202 into a full open position. Thus maximum flow to high pressure pump inlet 106 will occur. During engine warm-up, high pressure pump 50 will develop sufficient pressure to allow pressure regulating valve 205 to function at which time pressure control valve 204 will likewise function. In the preferred embodiment and in the event of an electrical failure of solenoid 225, pressure control valve 204 is designed to reduce control pressure $P_C$ to zero with the result that regulated pressure $P_R$ only acts on mechanical actuator 203. Regulated pressure $P_R$ is set to be sufficient to overcome the bias of flow control spring 213 and close or materially reduce the flow of fluid through flow control valve 202. The result is then that high pressure pump 50 is starved for fluid and the engine stalls because there is insufficient pressure to operate the fuel injectors. Alternatively, the setting of regulated pressure $P_R$ coupled with the setting for spring bias 213 and the design of flow control valve 202 (as explained below) can be set such that when electrical failure of solenoid 225 occurs, there is sufficient high pressure pump inlet pressure $P_{I2}$ to allow the fuel injectors to minimally operate. The vehicle could then operate in a "limp home" mode.

It should be clear from the discussion of FIG. 6 that there is, for all intents and purposes, an insignificant flow of fluid through pressure control valve 204 and pressure regulating valve 205 or the mechanical actuator 203. Thus the functioning of the components which regulate flow control valve 202 are isolated from the effects of viscosity or changes in the viscosity of the fluid flowing through flow control valve 202. Parasitic power losses are also minimized due to minimal flow losses.

Further the regulating pressure $P_R$ (while higher than charge pump pressure $P_{I1}$) is set at a relatively low value when compared to the pump output pressure $P_O$. This relatively low pressure lends itself to rapid and responsive modulation through pressure control valve 204. Solenoid 225 can be selected as a small sized, low cost but truly responsive item. By way of example and not necessarily limitation, in the preferred embodiment, initial charge pump pressure $P_{I1}$ can range from 0 to 7 bar; high pressure inlet pump pressure $P_{I2}$ can range from [(0 to 7 bar)−1]; high pressure outlet pump pressure $P_O$ can range from 0 to 280 bar; regulated pressure $P_R$ is set at a constant pressure established by the relationship of spring 213 and valve 204 (The preferred embodiment utilizes production established components and a 32 bar setting. Other settings are possible) and the control pressure $P_C$ can vary from 0 to 18 bar. The flow range of low pressure pump is 0–25 Lpm and the viscosity range of the fluid, which in the preferred embodiment is engine oil, is 8–10,000 cSt.

Figure 7:
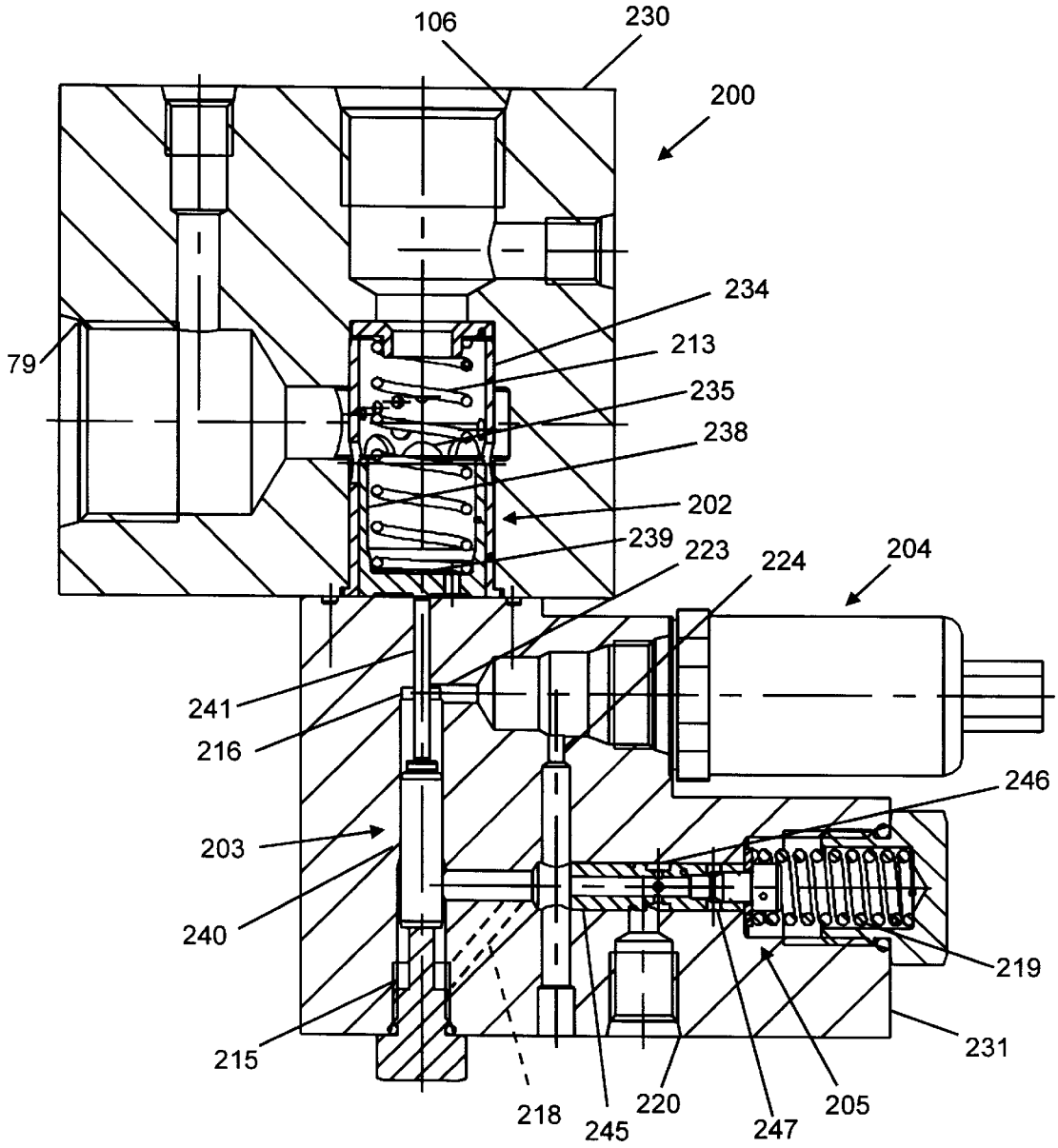
FIG. 7 is a sectioned view of the throttling view of the present invention.
Figure 8:
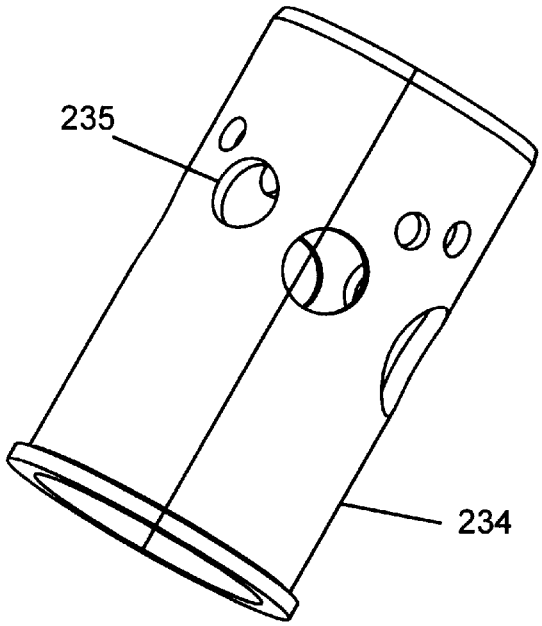
FIG. 8 is a perspective view of the sleeve used in the flow control valve of the present invention.

Referring now to FIG. 7 there is shown in sectioned view, throttling valve 200 and reference numerals used with respect to discussing the functioning of throttling valve 200 in FIG. 6 will apply to FIG. 7. Throttling valve 200 shown in FIG. 7 has a first casing section 230 containing flow control valve 202 and a second casing section 231 containing mechanical actuator 203, pressure control valve 204 and pressure regulator valve 205. It is contemplated that first casing section 230 may be formed integral with pump housing 56. Accordingly throttling valve inlet is designated as reference numeral 79 which is the inlet in high pressure pump 50 that is in fluid communication with low pressure pump 23 and throttling valve outlet is designated as reference numeral 106 which is the inlet for high pressure pump 50. Within first casing section is a drilled passage providing fluid communication between throttling valve inlet and outlet, 79, 106. Within the drilled passage is a cylindrical sleeve 234 and reference may had to FIG. 8 which shows a perspective view of sleeve 234. In the preferred embodiment, one axial end of sleeve 234 is adjacent throttling valve outlet 106 and the opposite axial end of sleeve 234 is adjacent second casing section 231. In-between the axial ends of sleeve 234 is a plurality of longitudinally spaced orifice openings 235 in fluid communication with throttling valve inlet 79. The orifice openings permit low pressure pump fluid to flow from throttling inlet 79 through orifice openings 235 into the interior of sleeve 234 and out through throttling outlet 106. Each orifice opening 235 is dimensionally sized relative to its longitudinal position with respect to throttling inlet 79. In the preferred embodiment, the largest orifice openings 235 are positioned closest to the closed axial end of sleeve 235, i.e., adjacent second casing section 231.

Within sleeve 234 is a slidable hollow piston 238 which has a closed end 239 adjacent second casing section 231. Flow control valve spring 213 has one end seated against hollow piston closed end 239 and the other end seated against throttling valve outlet 106 biasing hollow piston closed end out of sleeve 234 and into contact with abutting second casing section 231. In this position which is shown in FIG. 7 flow control valve 202 is wide open and maximum flow occurs between throttling valve inlet 79 and outlet 106. As explained with respect to the discussion of FIG. 6, mechanical actuator 203 under the control of solenoid actuated control valve 204 regulates the position of piston 238 in sleeve 235. As is well known in HEUI applications, during cold start of the engine, the engine oil has a viscosity significantly different than that when the engine is at normal operating temperature. Further the force to move hollow piston 238 against the flow (i.e., to close) increases as the viscosity increases. It is important to keep the low pressure pump flow at a maximum at the time of cold start and during warm-up of the engine until oil thins to a desired viscosity, even if initial control instructions from the ECM have to be overridden. The sleeve/piston/variable orifice arrangement discussed for flow control valve 202 is somewhat ideal for this application. Specifically, orifice openings 235 can be set to produce a two-staged flow having a first stage which leaves the valve open and sluggish for a limited travel distance and a second stage where the flow can be precisely metered. As the viscosity of the oil thins, the force required to move the valve diminishes and places it into the second stage where it becomes extremely responsive to slight force changes.

Those skilled in the art will recognize that many geometrical variations in the sleeve/piston arrangement shown in FIG. 7 are possible. For example, variable orifice openings 235 could be provided in piston 238 instead of sleeve 234. The positions of throttling valve inlet and outlet 79, 106 could be reversed or both could be longitudinally positioned along sleeve 234. While the variations mentioned are possible and functional, the preferred arrangement for valve stability and valve response is as shown in FIG. 7.

Referring still to FIG. 7, mechanical actuator 203 simply comprises a shuttle or spool 240 sealingly disposed within a drilled passage in second casing 231. Attached to one end of spool 240 is an actuator plunger 241 in contact with piston closed end 239. At one end of spool 240 is closing passage 215 which receives fluid at regulated pressure $P_R$ and at the opposite end of spool 240 is control passage 216 receiving fluid at control pressure $P_C$. Pressure in closing passage 215 exerts a force on spool 240 tending to move spool 240 upward in the plane of the drawing shown in FIG. 7 against piston 238. Pressure in control passage 216 exerts a force on spool 240 tending to move spool 240 downward in the plane of the drawing shown in FIG. 7 out of second casing 231. Spring bias 213 plus the pressure in control passage 216 acts against the pressure in closing passage 215.

The advantage of a pilot operated (i.e., spool 240) valve compared to a solenoid operated flow control valve can now be explained. First as a matter of definition:

$Q_{IN}$=inlet flow from charge pump 23;

$A_{MV}$=Area opening of variable orifices 235 in flow control valve 202;

$P_R$=limited pressure, for example 40 bar, established by regulating valve 205;

$A_{PV}$=pilot valve area defined as diameter of spool 240;

$P_C$=control pressure established by pressure control, solenoid valve 204;

$X_{PV}$=axial movement of spool 240 (until stopped by spring 213);

$Q_{PV}$=flow across variable orifices 235 in sleeve 234.

For throttling valve 200 as defined, the proportionality producing valve control are as follows:

$Q_{IN} \sim A_{MV}$;

$A_{MV} \sim X_{PV}$;

$X_{PV} \sim \Delta P$;

$\Delta P = P_R - P_C$

For a flow control valve, one must reference the proportionality $Q_{PV} \sim \sqrt{\Delta P}$. Controlling the flow linearly with respect to current from a solenoid operated flow control valve will then produce a $X_{PV}$ vs. current curve that is second order. This translates to poor control at the low end of the flow curve in the throttling valve. Utilizing the pilot operate pressure control valve disclosed, one must reference the fact that $\Delta P = P_R - P_C$. Since $P_R$ is a constant, this relationship is always linear, thus a linear $P_C$ vs. current curve will produce a linear relationship between the current and $X_{PV}$, This is the preferred control relationship.

Pressure regulating valve 205 is conventional and will not be described in detail herein. In FIG. 7, a regulating spool 245 in regulating valve 205 is shown in its free state in which $P_O$ at regulating valve inlet 220 is less than or equal to $P_R$. As $P_O$ becomes greater than or equal to $P_R$, the pressure in regulating valve outlet 218 moves regulating spool 245 towards the right as viewed in FIG. 7 against the bias of regulating spring 219. A land 246 in regulating spool 245 comes in line with a land (not shown) in regulating valve body. As fluid at pressure $P_O$ continues to leak into regulating valve outlet 218, regulating spool 245 continues to move towards the right, as viewed in FIG. 7, until a cross hole 247 reaches a position whereat it opens to a spring chamber (i.e., sump). This vents a small amount of oil at $P_R$ from valve outlet 218 moving regulator spool 245 towards the left to its modulated position whereat land 246 aligns with the land in the valve body.

Figure 9:
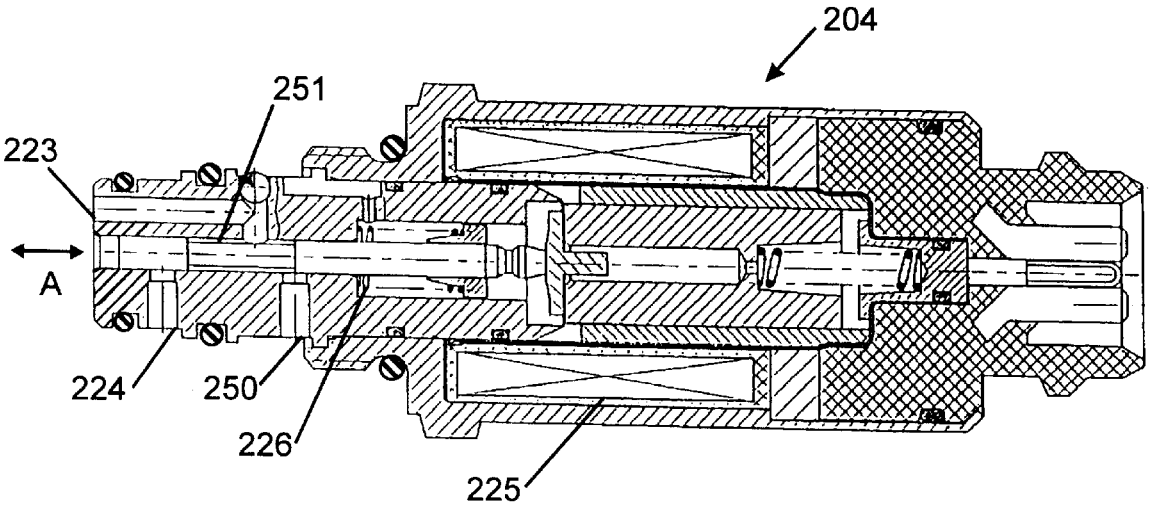
FIG. 9 is a sectioned view of a solenoid actuated pressure control valve used in the throttling valve of the present invention; and, FIG. 10 is a schematic view of an alternative embodiment of the present invention similar to FIG. 6.

Solenoid actuated pressure control valve 204 is also conventional and a conventional solenoid valve is shown in FIG. 9. The sump drain diagrammatically shown in FIG. 6 is shown as drain port 250 in FIG. 9. A control spool 251 is configured to close or open either control pressure inlet 224 or drain port 250 providing selective communication with control valve outlet 223. Control spool 251 includes a control spring seat 252 swaged thereto and control spring 226 biases control spool 251 to the right in the plane of FIG. 9. When current is generated in the solenoid wiring 225 an electrical field moves control spool 251 toward the left in the plane of the drawing shown in FIG. 9 against the bias of control spring 226. Fluid at regulated $P_R$ enters control inlet 224 and builds pressure in control outlet 223 and also in the "A" direction against control spring 226 to establish flow from control outlet 223 to drain outlet 250 and thereby establish modulation of the control valve 204. The pressure build in the "A" direction is related to the current level inputted to solenoid 225 and is usually stored in a look-up table in ECM 18 whereby control of pump 50 is effected.

Figure 10:
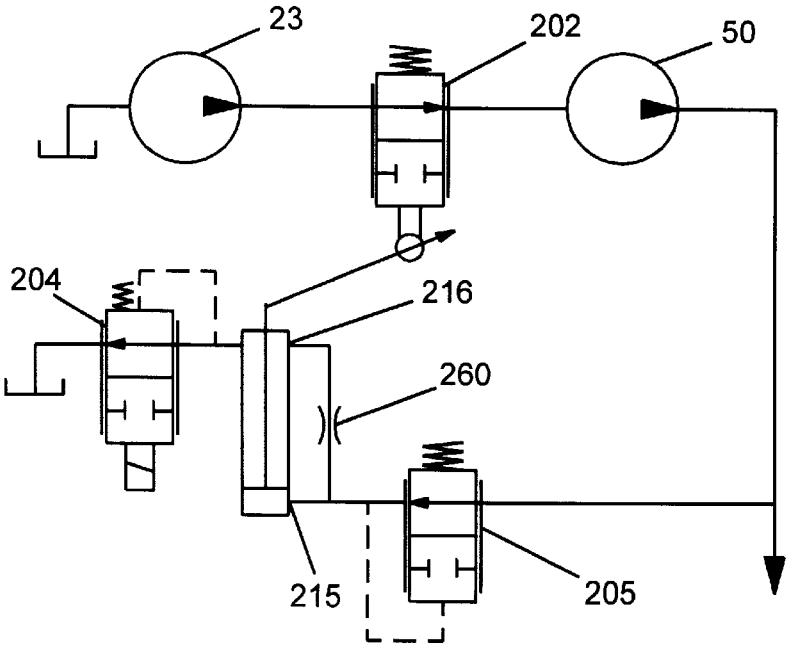

An alternative embodiment is illustrated in FIG. 10 which uses similar components as that set forth in the preferred embodiment and the same reference numerals used in describing the preferred embodiment will apply to the alternative embodiment. FIG. 10 is cited as an alternative embodiment only because it discloses a pilot operated throttling valve and in particular a flow control valve regulated by a mechanical actuator as discussed above for FIGS. 6 and 7. In FIG. 10 an orifice 260 is provided between the closing and control ends 215, 216 of mechanical actuator 203. Under static conditions, i.e., when flow control valve 204 is closed (no flow), actuator spool 240 is balanced and flow control spring 213 biases flow control valve 202 into a full open position. However, this alternative embodiment functions during normal operation by solenoid control valve 204 operating to cause a controlled flow of fluid through control end 216 of mechanical actuator 203 through solenoid control valve 204 to drain. The flow of fluid through orifice 260 results in a pressure drop establishing the pressure differential on actuator spool 240 to control the slave flow control valve 202 as described above. The fluid flow through solenoid control valve 204 exposes the solenoid actuated control valve to the viscosity changes of the fluid and the variations in the flow forces which are avoided in the solenoid actuated control valve 204 in the preferred embodiment illustrated in FIGS. 6–9. In the preferred embodiment, solenoid actuated control valve 204 is only controlling pressure and communication to drain port 250 is only that necessary to establish the desired control pressure $P_C$ so that flow considerations through the valve are insignificant in the "meter in" arrangement of the preferred embodiment. In the alternative "meter out" arrangement flow considerations through solenoid actuated control valve 204 have to be considered in the control valve design and the solenoid sized accordingly. For this reason, the alternative embodiment is not preferred and is simply disclosed to show an alternative pilot valve arrangement which can be used in the inventive throttled inlet pump/throttling valve system applications of the invention.

The invention has been described with reference to a preferred and alternative embodiment. Obviously alterations and modifications will occur to those skilled in the art upon reading and understanding the Detailed Description set forth herein. In particular the specifications discuss the throttling valve for use in a HEUI application which place specific demands on the throttling valve that are reflected in the throttling valve design. However, the inventive throttling valve and the inventive throttled inlet pump/throttling valve system disclosed herein can be used in other applications such as power steering pump applications or in an unrelated industrial applications. It is intended to include all such modifications and alterations insofar as they come within the scope of the present invention.

Having thus defined the invention, it is claimed:

1. In an internal combustion engine having a hydraulically-actuated electronically-controlled fuel injection system of the type including a fuel injector valving high pressure fluid in response to commands from an ECM to timely inject a metered quantity of fuel into the engine's combustion chamber; the injector in fluid communication with the outlet of a high pressure pump in turn having an inlet in fluid communication with a low pressure pump; the improvement comprising:

said high pressure pump being of a type in which the flow of high pressure fluid from the outlet thereof can be varied in response to a variation of flow at the inlet of said high pressure pump, and a throttling valve having an inlet in fluid communication with said low pressure pump and an outlet in fluid communication with said high pressure pump, said throttling valve having a flow control slave valve providing a variably set flow from said throttling valve inlet to said throttling valve outlet and a pilot operated, mechanical actuator controlling said variably set flow of said slave valve.

2. The improvement of claim 1 wherein said throttling valve includes a regulating valve for exerting a generally constant pressure on said mechanical actuator tending to close said set flow of said slave valve and a solenoid actuated pressure control flow exerting a pressure on said mechanical actuator acting opposite to said constant pressure.

3. The improvement of claim 2 wherein said ECM controls the actuation of said solenoid valve.

4. The improvement of claim 2 wherein said slave valve includes a slave valve housing containing a flow valve passage therein extending from said inlet to said outlet; a longitudinally extending, cylindrical sleeve within said flow valve passage having an inlet opening in fluid communication with said inlet and an outlet opening in fluid communication with said outlet; a cylindrical hollow piston having a closed end within said sleeve; a spring biasing said piston towards one end of said sleeve; and at least one of said piston and said sleeve having a plurality of longitudinally spaced orifice openings of set variable size extending therethrough for providing fluid communication from said throttling valve inlet to said throttling valve outlet through select orifice openings at least partially in registry with one of said inlet and said outlet openings depending on the longitudinal position of said piston in said sleeve.

5. The improvement of claim 4 wherein said sleeve has said orifice openings extending along its length, said throttling valve outlet at an axial end of said sleeve and said throttling valve inlet extending to a longitudinal position adjacent said sleeve, said spring biasing said piston to the axial end of said sleeve opposite said throttling valve outlet.

6. The improvement of claim 5 wherein said orifice openings are sized and positioned to provide maximum flow from said throttling valve inlet to said throttling valve outlet through said sleeve when said piston is at said opposite axial end of said sleeve.

7. The improvement of claim 4 wherein said mechanical actuator includes a spool casing having a longitudinally extending spool passage extending therethrough, said spool casing further having a closing passage in fluid communication with said spool passage and a control passage in fluid communication with said spool passage; a spool within said passage between said regulating passage and said control passage and a sealed plunger extending from one end of said spool in contact with said piston whereby fluid under pressure from said regulating valve in said closing passage biases said spool towards said piston and fluid under pressure from said pressure control valve in said control passage in combination with said spring bias exert an opposite bias on said spool.

8. The improvement of claim 7 wherein said regulating valve is a spring biased valve having a regulating valve inlet in fluid communication with said high pressure pump and a regulating valve outlet in fluid communication with said regulating passage.

9. The improvement of claim 8 wherein said solenoid valve is a valve actuated by a solenoid and having a solenoid valve inlet in fluid communication with said regulating valve outlet and an outlet in fluid communication with said control passage whereby said solenoid controls only pressure within control passage through modulation of fluid at regulated pressure from said regulating valve.

10. The improvement of claim 9 wherein said spool casing additionally includes a return control passage in fluid communication with said control passage and an orifice feed passage in fluid communication with said control passage; said solenoid valve actuated by a solenoid and having a solenoid valve inlet in fluid communication with said return control passage and said regulating valve outlet in fluid communication with said orifice feed passage.

11. The improvement of claim 9 wherein said solenoid actuated valve is set to produce minimum control pressure at minimum current and no control pressure on electrical failure whereby flow through said slave valve is minimal when electrical failure occurs.

12. The improvement of claim 11 wherein said high pressure pump is an axial piston, fixed displacement pump producing a generally constant flow of fluid throughout the operating range of said high pressure pump.

13. the improvement of claim 12 wherein said slave valve housing is formed as part of the housing of said pump.

14. The combination comprising:

a pump having an inlet receiving incoming fluid at an inlet pressure and an outlet for transmitting outgoing fluid at a higher pressure, and a pilot operated throttling valve regulating the flow of said incoming fluid to said pump inlet whereby the flow of said outgoing fluid may be regulated, wherein said pump has a piston bore and an orifice providing timed communication of said fluid from said inlet through said orifice to said piston bore.

15. The combination of claim 14 further including a charge pump providing the source of said incoming fluid;

said throttling valve having a throttling valve inlet in fluid communication with said incoming fluid pumped from said charge pump and an outlet in fluid communication with said inlet of said pump, said throttling valve having a flow control slave valve providing a variably set flow from said throttling valve inlet to said throttling valve outlet and a pilot operated, mechanical actuator controlling said variably set flow of said slave valve.

16. The combination of claim 15 wherein said throttling valve includes a regulating valve for exerting a generally constant pressure on said mechanical actuator tending to close said set flow of said slave valve and a solenoid actuated pressure control flow exerting a pressure on said mechanical actuator acting opposite to said constant pressure.

17. The combination of claim 16 wherein said flow control valve has a piston biased by a flow control spring for opening and closing orifice openings providing fluid communication from said throttling valve inlet to said throttling valve outlet; said mechanical actuator includes a spool casing having a longitudinally extending spool passage extending therethrough, said spool casing further having a closing passage in fluid communication with said spool passage and a control passage in fluid communication with said spool passage; a spool within said passage between said regulating passage and said control passage and a sealed plunger extending from one end of said spool in contact with said piston whereby fluid under pressure from said regulating valve in said closing passage biases said spool towards said piston and fluid under pressure from said pressure control valve in said control passage in combination with said flow control spring bias exert an opposite bias on said spool.

18. The combination of claim 17 wherein said solenoid valve is a valve actuated by a solenoid and having a solenoid valve inlet in fluid communication with said regulating valve outlet and an outlet in fluid communication with said control passage whereby said solenoid controls only pressure within said control passage through modulation of fluid at regulated pressure from said regulating valve.

19. The combination of claim 18 wherein said pump is an axial piston, fixed displacement pump producing a generally constant flow of fluid throughout the operating range of said high pressure pump.

20. A HEUI system comprising:

a) fuel injector valving high pressure fluid in response to commands from an ECM to timely inject metered quantities of fuel into the combustion chambers of an internal combustion engine;

b) a high pressure pump supplying fluid at high pressure to said injectors;

c) a low pressure pump for changing the inlet of said high pressure pump with said fluid at a low pressure; and, d) a throttling valve having a throttling valve inlet in fluid communication with said low pressure pump and a throttling valve outlet in fluid communication with said high pressure pump, said throttling valve having a flow control slave valve providing a variably set flow from said throttling valve inlet to said throttling valve outlet and a pilot operated, mechanical actuator controlling said variably set flow of said slave valve.

21. The system of claim 20 wherein said high pressure pump has a piston bore and an orifice providing timed communication of said fluid from said inlet of said high pressure pump through said orifice to said piston bore.

22. The system of claim 21 wherein said throttling valve includes a regulating valve for exerting a generally constant pressure on said mechanical actuator tending to close said set flow of said slave valve and a solenoid actuated pressure control flow exerting a pressure on said mechanical actuator acting opposite to said constant pressure.

23. The improvement of claim 22 wherein said ECM controls the actuation of said solenoid valve.

24. The improvement of claim 23 wherein said slave valve includes a slave valve housing containing a flow valve passage therein extending from said inlet to said outlet; a longitudinally extending, cylindrical sleeve within said flow valve passage having an inlet opening in fluid communication with said inlet and an outlet opening in fluid communication with said outlet; a cylindrical hollow piston having a closed end within said sleeve; a flow control spring biasing said piston towards one end of said sleeve; and at least one of said piston and said sleeve having a plurality of longitudinally spaced orifice openings of set variable size extending therethrough for providing fluid communication from said throttling valve inlet to said throttling valve outlet through select orifice openings at least partially in registry with one of said inlet and said outlet openings depending on the longitudinal position of said piston in said sleeve.

25. The improvement of claim 4 wherein said sleeve has said orifice openings extending along its length, said throttling valve outlet at an axial end of said sleeve and said throttling valve inlet extending to a longitudinal position adjacent said sleeve, said spring biasing said piston to the axial end of said sleeve opposite said throttling valve outlet.

26. The improvement of claim 5 wherein said orifice openings are sized and positioned to provide maximum flow from said throttling valve inlet to said throttling valve outlet through said sleeve when said piston is at said opposite axial end of said sleeve.

27. The improvement of claim 4 wherein said mechanical actuator includes a spool casing having a longitudinally extending spool passage extending therethrough, said spool casing further having a closing passage in fluid communication with said spool passage and a control passage in fluid communication with said spool passage; a spool within said passage between said regulating passage and said control passage and a sealed plunger extending from one end of said spool in contact with said piston whereby fluid under pressure from said regulating valve in said closing passage biases said spool towards said piston and fluid under pressure from said pressure control valve in said control passage in combination with said flow control spring bias exert an opposite bias on said spool.

28. The improvement of claim 27 wherein said regulating valve is a spring biased valve having a regulating valve inlet in fluid communication with said high pressure pump and a regulating valve outlet in fluid communication with said regulating passage.

29. The improvement of claim 28 wherein said solenoid valve is a valve actuated by a solenoid and having a solenoid valve inlet in fluid communication with said regulating valve outlet and an outlet in fluid communication with said control passage whereby said solenoid controls only pressure within control passage through modulation of fluid at regulated pressure from said regulating valve.

* * * * *